United States Patent [19]

Olson

[11] Patent Number: 5,044,244

[45] Date of Patent: Sep. 3, 1991

[54] HEAVY DUTY PUNCH

[76] Inventor: Charles W. Olson, 2 Hanover La., Beachwood, Ohio 44122

[21] Appl. No.: 546,239

[22] Filed: Jun. 29, 1990

[51] Int. Cl.[5] ..... B26F 1/14

[52] U.S. Cl. ..... 83/686; 83/684; 83/679

[58] Field of Search ..... 83/680, 684, 685, 686, 83/691, 687, 679

[56] References Cited

U.S. PATENT DOCUMENTS

| | | | |
|---|---|---|---|
| 826,130 | 7/1906 | Vold | 83/685 |
| 900,009 | 9/1908 | Doolittle | 279/49 |
| 1,166,613 | 1/1916 | Mackle | 83/686 |
| 1,179,476 | 4/1916 | Thomas | 83/686 X |
| 1,489,881 | 4/1924 | Doolittle | 279/91 |
| 4,273,015 | 6/1981 | Johnson | 83/686 X |
| 4,526,077 | 7/1985 | DeGuvera | 83/686 |
| 4,621,556 | 11/1986 | Soltysiak et al. | 83/670 |

*Primary Examiner*—Frank T. Yost
*Assistant Examiner*—Rinaldi Rada
*Attorney, Agent, or Firm*—Weston Hurd Fallon Paisley & Howley

[57] ABSTRACT

A heavy duty punch for piercing armor plate and the like has a shank by which the punch may be held when in use and a piercing end projecting axially from the shank. The piercing end terminates in a sharp-edged tip. The tip is connected to the shank by a reduced-diameter portion defined by a curved sidewall extending axially from the tip toward the shank and a straight-sided sidewall extending axially from the curved sidewall toward the shank. The straight-sided sidewall is spaced from the tip a distance slightly greater than the thickness of the workpiece being punched; the diameter of the straight-sided sidewall is slightly less than the diameter of the tip.

8 Claims, 1 Drawing Sheet

HEAVY DUTY PUNCH

BACKGROUND OF THE INVENTION

1. Field of the Invention

The invention relates to punches for piercing holes in workpieces and, more particularly, to punches for piercing holes in heavy workpieces such as armor plate, truck leaf springs, and the like.

2. Description of the Prior Art

In the course of manufacturing heavy workpieces such as armor plate, truck leaf springs, plow shares, bulldozer blades, truck frame rails, and similar thick, hard items, it frequently is necessary to form holes in the workpieces so that the workpieces can be connected to other items by means of bolts or rivets. Due to the thickness of the workpieces and due to their hardness, it is difficult to form holes in the workpieces in an economical manner.

While drills have been used to form such holes, drilling is a relatively time-consuming and expensive operation. The drills must be sharpened frequently, and they frequently must be replaced after the formation of only a relatively few holes.

Due to the limitations inherent in drilling operations, it has become conventional practice to form holes in heavy workpieces by means of heavy duty punches. As used herein, the term "heavy workpieces" refers to workpieces that are very hard (typically a Rockwell hardness rating as great as 45C), or very thick (usually within the range of about 0.25 inch to 1.5 inches). The workpieces that are being punched typically are made of a difficult-to-punch material such as steel, usually heat-treated steel. Not only is the material thick and hard, but the size of the holes themselves presents a problem. Frequently, it is necessary to punch holes that have a diameter approximating that of the thickness of the workpiece itself. Punching large holes in thick workpieces that are made of a hard material is an exceedingly difficult operation.

An early approach to the problem is shown in U.S. Pat. No. 900,009 issued Sept. 29, 1908 to J. F. Doolittle. In the '009 patent, a punch includes a shank from which a piercing end projects axially. The piercing end is relatively long and slender, and terminates in a tip having a diameter equal to that of the hole to be punched. The sidewalls of the piercing end taper in a straight line from the tip to a reduced-diameter portion adjacent the shank. A problem with the punch according to the '009 patent is that the relatively great distance from the tip to the reduced-diameter portion provides a long moment arm that permits the punch to be bent or broken if a misalignment between the punch and the workpiece or the punch and a punch-receiving die should occur.

Another problem relates to difficulties that occur when the punch is removed, or stripped, from the workpiece. It has been found that it takes almost as much force to strip the punch as it does to pierce the workpiece. The punch disclosed in the '009 patent presents substantial difficulties in stripping the punch from the workpiece, in part because the sidewalls are almost the same diameter as the tip. In addition, if the punch should be misaligned with the hole during the stripping operation, the punch could be damaged or broken.

U.S. Pat. No. 1,489,881, issued Apr. 8, 1924 to J. F. Doolittle, discloses an improved punch. In the '881 patent, the piercing end of the punch has a reduced slenderness ratio, that is, the piercing end has a proportionally greater diameter for a given length of piercing end than that disclosed in the '009 patent. Nevertheless, the punch disclosed in the '881 patent includes a reduced-diameter portion adajcent the shank, as in the '009 patent. Accordingly, a relatively long moment arm is provided that fails to address adequately the breaking and stripping problems noted above.

A more recent approach is disclosed in U.S. Pat. No. 4,526,077, issued July 2, 1985 to E. W. DeGuvera. In the '077 patent, the punch includes a piercing end that terminates in a tip having a conical end portion, and a sidewall connecting the tip and the shank that either has no taper or a nominal taper of about 0°15' to 0°30'. In effect, the '077 patent discloses a nominally tapered straight-sided sidewall as in the '009 and '881 patents. While the punch according to the '077 patent is believed to be more effective than the earlier punches, it still presents problems concerning breaking and stripping due to the taper of the sidewall and the location of the smallest-diameter portion of the piercing end relative to the tip.

Desirably, a heavy duty punch would be available that would overcome the drawbacks of prior art punches regarding breaking and difficulties in stripping. It is hoped that any such punch would be relatively easy to manufacture from readily available materials commonly used for manufacturing heavy duty punches.

SUMMARY OF THE INVENTION

In response to the foregoing concerns, the present invention provides a new and improved heavy duty punch for piercing holes in heavy workpieces. The punch according to the invention includes a shank by which the punch may be held when in use and a piercing end that projects axially from the shank. The piercing end terminates in a tip having a diameter equal to the diameter of the hole to be punched. A reduced-diameter portion connects the tip and the shank, the reduced-diameter portion including a curved sidewall extending axially from the tip toward the shank, and a straight-sided sidewall extending axially from the curved sidewall toward the shank. The diameter of the straight-sided sidewall is slightly less than the diameter of the tip. The intersection of the curved sidewall and the straight-sided sidewall is located a distance from the tip slightly greater than the thickness of the workpiece.

In the preferred embodiment, the curved sidewall, in cross-section, is defined by a curved segment of the circumference of a circle passing through (a) the edge of the tip, (b) a point equal to the diameter of the tip less about 0.040 inch, and (c) the intersection of the curved sidewall and the straight-sided sidewall. The diameter of the straight-sided sidewall desirably is 0.015 inch less than the diameter of the tip; the straight-sided sidewall desirably is located from the tip a distance about 0.032 inch greater than the thickness of the workpiece. Preferably, the axial extent of the straight-sided sidewall is approximately 0.032 inch. Also, it is preferred that the straight-sided sidewall be connected to the shank by a smoothly contoured sidewall portion.

The punch according to the invention has a number of advantages. By locating the smallest-diameter portion of the piercing end relatively close to the tip, the length of the moment arm between the tip and the smallest-diameter portion is reduced, thereby minimizing, or possibly even eliminating, breakage. Further, by providing a straight-sided sidewall having a diameter slightly less than that of the hole being punched and by locating the straight-sided sidewall from the tip of a distance slightly greater than the thickness of the material being punched, the tip can pass completely through the workpiece before any contact between the straight-sided sidewall and the workpiece can occur. After the tip clears the lower surface of the workpiece, the straight-sided sidewall can enter the hole formed in the workpiece without binding in the hole. Stress on the piercing end is reduced, thereby minimizing the possibility of breaking the punch.

The punch according to the invention also is easier to strip than prior punches, thereby reducing the possibility of breakage. This result is brought about in part by the shape of the curved sidewall. The curved sidewall cannot contact the sides of the hole, even if the punch should become misaligned during the stripping process.

The foregoing, and other features and advantages of the invention, will be apparent from reviewing the following description and claims, taken in conjunction with the accompanying drawings.

DESCRIPTION OF THE PREFERRED EMBODIMENT

Figure 1:
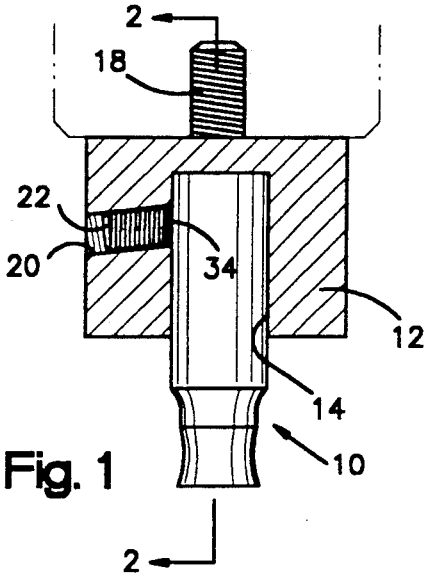
FIG. 1 is a cross-sectional view of a punch according to the invention installed in a punch holder.
Figure 2:
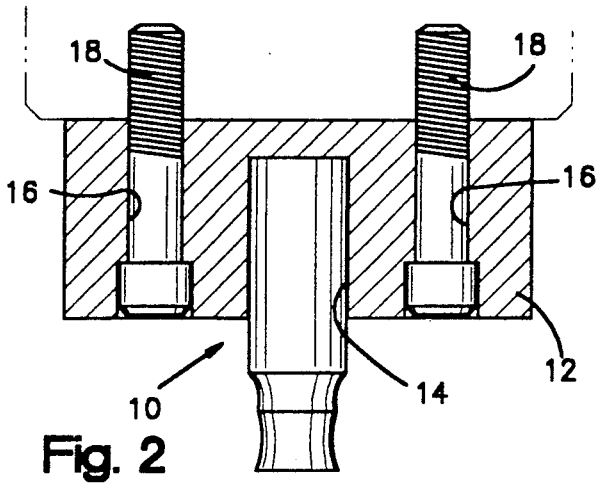
FIG. 2 is a cross-sectional view of the punch and punch holder of FIG. 1 taken along a plane indicated by line 2—2 in FIG. 1.
Figure 3:
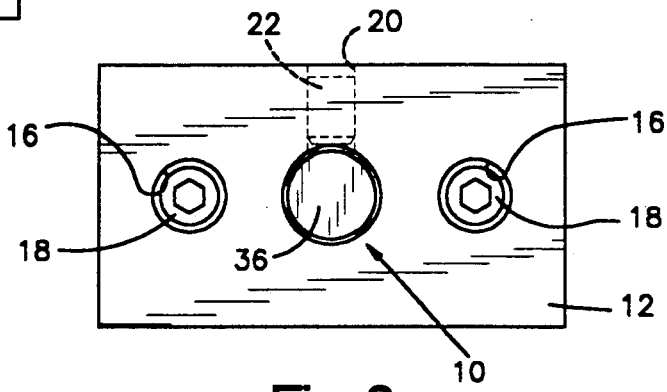
FIG. 3 is a bottom plan view of the punch and punch holder of FIG. 1.

Referring to FIGS. 1-4, a heavy duty punch according to the invention is indicated generally by the reference numeral 10. The punch 10 is adapted for use with a punch holder 12. The punch holder 12 is a generally cubic structure having a cylindrical opening 14 formed therein. The punch holder 12 also includes a pair of counterbored openings 16 disposed on either side of the opening 14. The openings 16 are adapted to receive bolts 18 in order to connect the punch holder 12 to remaining portions of the punch machinery (not shown). The punch holder 12 also includes a threaded opening 20 that is adapted to receive a set screw 22. The opening 20 intersects the opening 14.

The punch 10 includes a generally cylindrical shank 30 from which a piercing end 32 projects axially. The shank 30 includes a detent portion 34. As will be apparent from reviewing FIGS. 1 and 3, when the shank 30 is positioned in the opening 14 and the detent portion 34 is oriented toward the set screw 22, the set screw 22 can be tightened so as to clamp the shank 30 securely within the opening 14.

Figure 4:
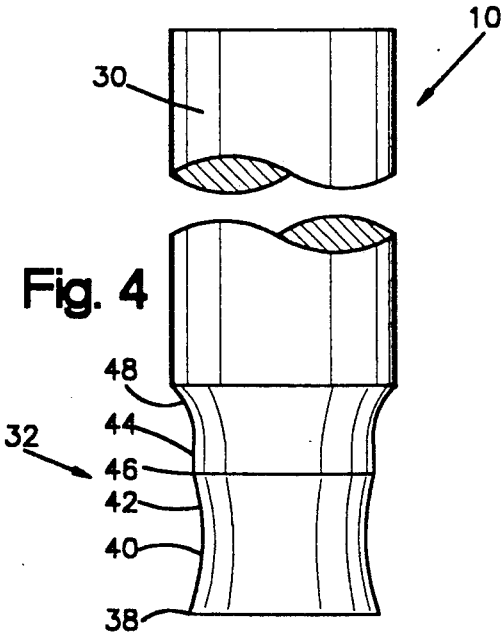
FIG. 4 is an enlarged side elevational view of the punch according to the invention.

The piercing end 32 includes a flat-bottomed tip 36 having a sharp edge 38 about its periphery. If desired, the tip 36 could be conical, or any conventional shape other than flat. Referring particularly to FIG. 4, the piercing end 32 includes a curved sidewall 40 that extends axially from the tip 36 toward the shank 30. The smallest-diameter portion of the curved sidewall 40 is indicated by the reference numeral 42.

A straight-sided sidewall 44 extends axially from the curved sidewall 40 toward the shank 30. The intersection of the curved sidewall 40 and the straight-sided sidewall 44 is indicated by the reference numeral 46. A curved sidewall portion 48 connects the straight-sided sidewall 40 and 44 and the shank 30.

It has been discovered that the various dimensions of the punch 10 are very important, not only in relation to each other, but also in relation to the thickness of the workpiece being punched. The thickness of the workpiece will be referred to by the letter (T), and the diameter of the hole to be formed (and also the diameter of the tip 36) will be identified by the letter (D). The diameter of the straight-sided sidewall 44 should be slightly less than (D), while the intersection of the curved sidewall 40 and the straight-sided sidewall 44 should be located from the tip a distance slightly greater than (T). Preferably, the diameter of the sidewall 44 is equal to (D) minus about 0.015 inch, and the intersection between the sidewalls 40, 44 is equal to (T) plus about 0.032 inch.

The dimensions of the curved sidewall 40 also are important to successful operation of the invention. It is desirable that the smallest-diameter section 42 be located relatively close to the tip 36 in order to reduce the stress that will be applied to the piercing end 32 during punching operations. A preferable profile for the curved sidewall 40 can be defined by a curved segment of the circumference of a circle passing through (a) the edge 38, (b) a point equal to (D) minus about 0.040 inch, and (c) the intersection 46. The axial extent of the sidewall 44 should not be very great, preferably about 0.032 inch. In order to reduce stresses that will be applied to the piercing end 32, the sidewall portion 48 should be shaped so as to provide a smooth transition between the sidewall 44 and the shank 30; a radius blend between the sidewall 44 and the shank 30 is preferred.

Figure 5:
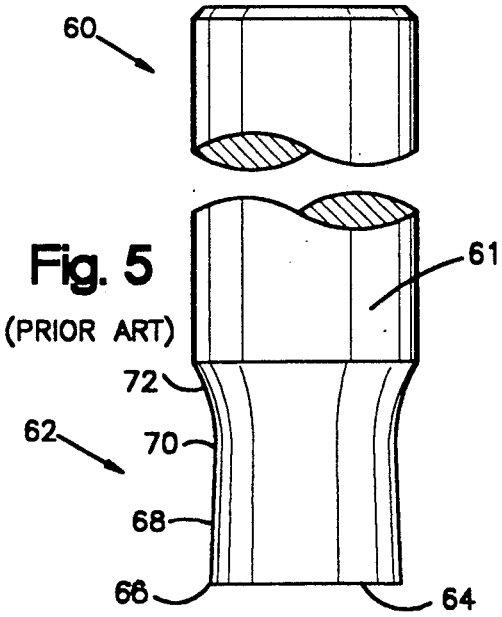
Fig. 5 (PRIOR ART)
FIG. 5 is an enlarged view of a punch according to the prior art.

Referring now to FIG. 5, a punch according to the prior art is indicated by the reference numeral 60. The punch 60 includes a shank 61 from which a piercing end 62 projects axially. The piercing end 62 has a tip 64 that includes a sharp edge 66. The piercing end 32 includes a straight-sided sidewall 68 that extends axially toward the shank 62. The sidewall 68 is "back-tapered" at an angle within the range of about 1.5° to 2°. The smallest-diameter portion of the piercing end 62 is indicated by the reference numeral 70. A curved sidewall portion 72 connects the sidewall 68 and the shank 61. The axial extent of the sidewall 68 typically is equal to the diameter of the tip plus about 0.125 inch. That is, the curved sidewall portion 72 is spaced from the tip 64 a distance slightly greater than the diameter of the tip 64.

The gap between the smallest-diameter portion 70 and the workpiece when the punch 60 is in the punched position is very great. Accordingly, excessive stress can be applied to the punch 60 in the region of the intersection between the sidewall 68 and the curved sidewall portion 72, thereby leading to possible breakage of the punch 60.

In contrast with the punch 60, the punch 10 locates the smallest diameter section 42 much closer to the tip of the punch. In terms of the diameter of the punch 10, the smallest-diameter section 42 is located about 40 percent of the diameter (D) away from the tip 36. By positioning the section 42 so close to the tip 36, the chances of breaking the punch 10 are greatly reduced compared with the punch 60 where the smallest-diameter portion is located more than one full tip diameter from the tip.

Another distinction between the punch 10 and the punch 60 is that the sidewall 40 of the punch 10 curves inwardly from the edge 38 must faster than the sidewall 70 tapers from the edge 68. This difference in rate of taper enables the punch 10 to be stripped easier from the workpiece because there is little or no possibility that the sidewall 40 can contact the hole during removal of the piercing end 32 from the hole, even if the punch 10 should become misaligned with respect to the hole.

Yet an additional distinction between the punch 10 and the punch 60 is that the punch 10 includes a straight-sided sidewall portion 44 that is spaced from the tip 36 a distance slightly greater than the thickness of the workpiece. By this construction, the tip 36 can pass completely through the workpiece before any contact between the sidewall 44 and the workpiece can occur. After the tip 36 clears the lower surface of the workpiece, the sidewall 64 can enter the hole formed in the workpiece without binding in the hole. If the piercing end 32 should be deflected for some reason (such as a misalignment between the punch 10 and the punch-receiving die disposed beneath the workpiece), contact between the sidewall 44 and the upper end of the workpiece will prevent damage to the punch 10. Accordingly, stress on the piercing end 32 will be reduced, thereby minimizing the possibility of breaking the punch 10.

As will be apparent from the foregoing description, the punch 10 can be manufactured readily from materials commonly used to manufacture punches. Tests conducted to date have indicated that the punch 10 is exceedingly effective in its punching action, and it is expected that the punch 10 will have a useful life far exceeding that of the punch 60 or any other known punch.

Although the present disclosure of the preferred embodiment has been described in its preferred form with a certain degree of particularity, it will be understood that the present disclosure of the preferred embodiment has been made only by way of example and that various changes may be resorted to without departing from the true spirit and scope of the invention as hereinafter claimed. It is intended that the patent shall cover, by suitable expression in the appended claims, whatever features of patentable novelty exist in the invention disclosed.

What is claimed is:

1. A heavy duty punch for piercing holes having a diameter (D) in workpieces having a thickness (T), comprising:

a shank by which the punch may be held when in use; and a piercing end projecting axially from the shank, the piercing end terminating in a tip having a diameter (D), the piercing end having a reduced-diameter portion connecting the tip and the shank, the reduced-diameter portion including a curved sidewall extending axially from the tip toward the shank, and a straight-sided sidewall extending axially from the curved sidewall toward the shank, the diameter of the straight-sided sidewall being equal to (D) minus about 0.015 inch, the intersection of the curved sidewall and the straight-sidewall being located a distance from the tip equal to (T) plus about 0.032 inch, the axial extent of the straight-sided sidewall being equal to about 0.032 inch, and the curved sidewall, in cross-section, being defined by a curved segment of the circumference of a circle passing through (a) the edge of the tip, (b) a point equal to (D) minus about 0.040 inch, and (c) the intersection of the curved sidewall and the straight-sided sidewall.

2. The punch of claim 1, wherein the shank has a diameter greater than (D), and the straight-sided sidewall is connected to the shank by a smoothly contoured sidewall portion.

3. A heavy duty punch for piercing holes having a diameter (D) in workpieces having a thickness (T), comprising:

a shank by which the punch may be held when in use; and a piercing end projecting axially from the shank, the piercing end terminating in a tip having a diameter D, the piercing end having a reduced-diameter portion connecting the tip and the shank, the reduced-diameter portion including a curved sidewall extending axially from the tip toward the shank and a straight-sided sidewall extending axially from the curved sidewall toward the shank, the diameter of the straight-sided sidewall being slightly less than (D) and the intersection of the curved sidewall and the straight-sided sidewall being located a distance from the tip slightly greater than (T).

4. The punch of claim 3, wherein the diameter of the straight-sided sidewall is equal to (D) minus about 0.015 inch.

5. The punch of claim 3, wherein the straight-sided sidewall is located a distance from the tip equal to (T) plus about 0.032 inch.

6. The punch of claim 3, wherein the axial extent of the straight-sided sidewall is approximately 0.032 inch.

7. The punch of claim 3, wherein the shank has a diameter greater than (D) and the straight-sided sidewall is connected to the shank by a smoothly contoured sidewall portion.

8. The punch of claim 3, wherein the curved sidewall, in cross-section, is defined by a curved segment of the circumference of a circle passing through (a) the edge of the tip, (b) a point equal to (D) minus about 0.040 inch, and (c) the intersection of the curved sidewall and the straight-sided sidewall.

* * * * *